United States Patent [19]

Yakematsu

[11] 4,323,822

[45] Apr. 6, 1982

[54] ELECTRIC FLASH DEVICE

[75] Inventor: Yoshiyuki Takematsu, Tokyo, Japan

[73] Assignee: Fuji Koeki Corporation, Tokyo, Japan

[21] Appl. No.: 944,893

[22] Filed: Sep. 22, 1978

[30] Foreign Application Priority Data

Sep. 25, 1977 [JP] Japan ..... 52-128649[U]
Oct. 22, 1977 [JP] Japan ..... 52-142363

[51] Int. Cl.[3] ..... H05B 41/32
[52] U.S. Cl. ..... 315/241 P; 315/225
[58] Field of Search ..... 315/241 P, 225; 354/145; 320/1; 363/18, 49, 74

[56] References Cited

U.S. PATENT DOCUMENTS

| | | | |
|---|---|---|---|
| 3,310,723 | 3/1967 | Schmidt et al. | 320/1 |
| 3,764,849 | 10/1973 | Ohta | 315/241 P |
| 4,065,700 | 12/1977 | Liebman | 315/241 P |
| 4,067,028 | 1/1978 | Lermann et al. | 315/241 P X |

*Primary Examiner*—Eugene R. LaRoche

*Attorney, Agent, or Firm*—Fleit & Jacobson

[57] ABSTRACT

This invention discloses an electric flash device which comprises a direct current power source circuit, a flash tube circuit including a flash tube, a voltage convertor including an oscillator circuit, an oscillating transformer and an oscillation starting circuit, a rectifier circuit for rectifying an altanating current voltage from the voltage convertor and a charging circuit including a main storage capacitor for storing an electric energy to be supplied to the flash tube, a triggering circuit for firing the flash tube, said oscillator circuit includes an oscillating switching element which has a high leak resistance, and said oscillation starting circuit includes a switch element for starting the actuation of said voltage convertor. In accordance with the electric flash device of the present invention, a power source switch is not required because said oscillation starting switch element is provided in the oscillation starting circuit and because said voltage convertor automatically stops activating in case of the flash operation is not performed for a predetermined time interval.

16 Claims, 6 Drawing Figures

ELECTRIC FLASH DEVICE

The present invention relates to a flash light generating apparatus, and more particularly to an electric flash device which generating a flash light by triggering a flash tube on.

BACKGROUND OF THE INVENTION

In recent years, a flash apparatus has been widely employed in various kinds of optical apparatus which requires light of flash. Particularly, in the art of photography, artificial light is used to illuminate an object to be photographed. One form of artificial light which into wide use is so-called a flash tube. In such devices, a flash tube is provided in order to illuminate an object to be photographed.

It is common practice in electric flash devices to obtain high intensity illumination for photographic purposes by discharging a charged capacitor through a gas-filled flash tube. A low voltage D.C. power source is generally employed together with suitable circuitry in order to obtain the relatively high D.C. voltage which is needed to charge the flash capacitor to a value for each firing of the flash tube. Since an electric flash device of this type is generally portable, batteries are usually employed as the source of low D.C. voltage. High D.C. voltage is obtained from the batteries through the use of a voltage convertor. A convertor includes a transformer for charging the low alternating voltage to high A.C. voltage, and a rectifier for converting the high A.C. voltage which is applied to the flash capacitor in order to charge it.

It can readily be understood that under ordinary circumstances when an electric flash device is being used, a substantial portion of the time during which the device is turned on may be standby time; that is, elapsed time after power supply has charged the capacitor to a suitable value and before the camera shutter is tripped discharging the capacitor through the flash tube. During this time the power supply consumes energy from the batteries without producing any useful results. The energy loss may be significant, particularly when the device includes transformers. As the batteries age their output voltage drops and a longer period of time is required for firing the flash tube. In addition, as the output voltage of the batteries decreases with age, the device becomes incapable to use for flashing the flash tube.

PRIOR ART

FIG. 1 shows an example of conventional and prior art electric flash device. As is shown in FIG. 1, the device comprises a direct current power source circuit A, a voltage convertor circuit B for converting direct current voltage from the direct current power source circuit A into alternating current voltage, a rectifier circuit C for rectifying the alternating current voltage, an electric charge storing circuit D for supplying electrical energy to a flash tube, a trigger pulse generating circuit E for triggering the flash tube, and a flash tube circuit F including a flash tube.

The direct current power source circuit A includes a battery 10 and a power source switch 12 which is connected to the battery 10 in series relationship. The power source switch 12 is a mechanical switch which is manually operated. The voltage convertor circuit B comprises an oscillator circuit, an oscillating time constant circuit having serially connected resistor 14 and capacitor 16, an oscillating transformer 18 having a primary winding 18*a*, a secondary winding 18*b* and a third winding 18*c*, and an oscillation switching element in the form of a PNP type Gerumanium transistor 20 whose internal resistance is extremely low.

The rectifier circuit C consists of a diode 22 whose anode electrode is connected to one terminal of the third winding 18*c* of the oscillating transformer 18. The electric charge storing circuit D includes a main storage capacitor 24, a current-restricting resistor 26 and an indicating lamp such as a neon lamp, and is connected as shown. The trigger pulse generating circuit includes a triggering time constant circuit having a charging resistor 30 and a triggering capacitor 32, and a trigger transformer 36 having a primary winding 36*a* and a secondary winding 36*b*. The flash tube circuit F includes a flash tube 38 whose main current conducting electrodes 38*a* and 38*b* are connected to the main storage capacitor 24 and whose trigger electrode 38*c* is connected to the secondary winding 36*b* of the trigger transformer 36.

In the electric flash device of FIG. 1, when the power source switch 12 is closed, the voltage convertor circuit B activates an oscillating operation, and thereby the high voltage is induced at the secondary winding 18*b* of the transformer 18. The boosted alternating current voltage is rectified by the rectifier circuit C, and thereafter electric charge is stored on the main storage capacitor 24. When the electric charge stored on the capacitor 24 reaches a predetermined value, the capacitor 24 discharges through the flash tube 38.

In thus conventional electric flash device, when the main storage capacitor 24 discharges the electric flash, the voltage convertor circuit B is affected by bad influence because the discharging current flows into the voltage convertor circuit through the transistor 20. Further, when the electric charge in the main storage capacitor discharged up, the voltage convertor circuit B tries to charge the electric charge on the main storage capacitor 24 in order to prepare the next flashing, so long as an user does not make the power source switch 12 to be OFF state. Accordingly, if the power source switch 12 is left its conductive condition for a long time interval, the voltage convertor circuit B continues an activation so as to maintain the charging of the main storage capacitor 24, and, therefore, the current from the battery 10 flows during the power source switch 12 is closed.

During this time the power supply consumes energy from the battery 10 without any useful results. As the battery ages its output voltage drops and a longer period of time is required for the main storage capacitor 24 to be charged to the necessary level for firing the flash tube 38. Furthermore, the electric flash device becomes an incapable condition of the operation.

As one method to resolve the above described drawbacks, an electric flash device shown in FIG. 2 has proposed, in which a timer circuit T is provided between a power source circuit A and a voltage convertor circuit B in order to interrupt the current which flows from the power source circuit A to the voltage convertor circuit B, in case a flash tube 38 is not fired within a given time period. The timer circuit T, however, includes a semiconductive element such as, for example, a power transistor Q which is serially connected to the power source circuit and the voltage convertor circuit B, and, as a result, the actual power input to the voltage convertor circuit B is lowered due to the highly and specific power loss of the power transistor Q. Accordingly, it is impossible to use the battery 10 effectively, in the device of FIG. 2.

OBJECT OF THE INVENTION

It is an object of the present invention, therefore, to provide an improved electric flash device for using a power supply effectively.

It is a more specific object of the invention to provide an improved electric flash device which can be interrupt the power source current automatically.

SUMMARY OF THE INVENTION

According to the present invention there is provided an electric flash device comprising a direct current power source, a flash tube circuit including a flash tube a voltage convertor circuit for converting a direct current voltage of said direct current power source to an alternating current voltage, a rectifier circuit for rectifying said alternating current voltage to a direct current voltage, a charging circuit for storing an electric charge and for supplying electrical energy to said flash tube, and a trigger pulse generating circuit for triggering said flash tube of the flash tube circuit, said voltage convertor circuit comprises an oscillating transformer for generating high alternating current voltage, an oscillator circuit including an oscillating switch element having a high leakage resistance, an oscillation starting circuit including a switching means for making said oscillator circuit to actuate and an oscillation biassing means.

DESCRIPTION OF THE DRAWINGS

Certain embodiments of the invention will now be described by way of examples and with reference to the accompanying drawings, wherein like parts in each of the several figures are identified by the same reference character, and wherein.

DETAILED DESCRIPTION OF THE PREFERRED EMBODIMENTS

Figure 1:
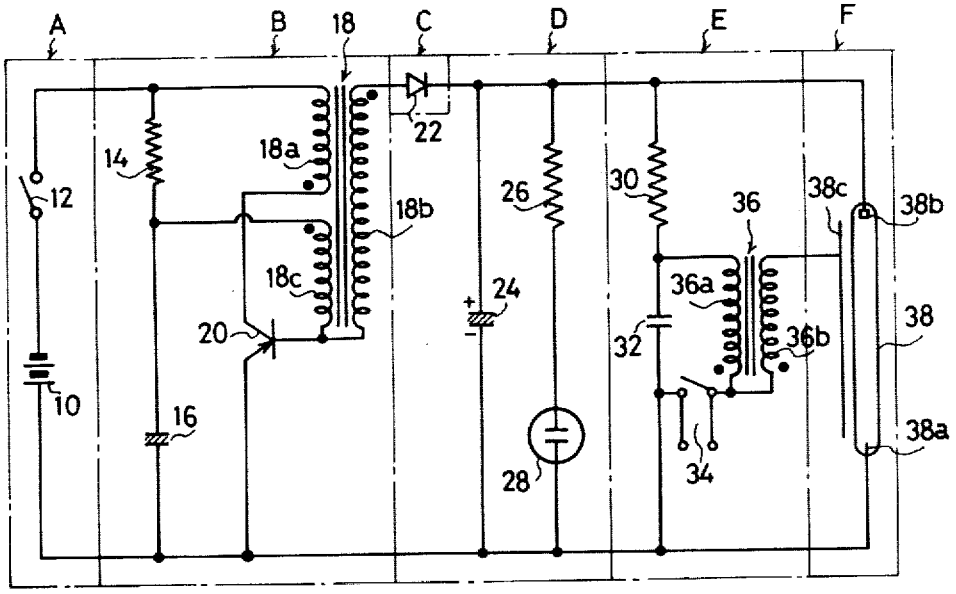
Fig.1 PRIOR ART
FIGS. 1 and 2, already referred to above, are circuit diagrams of prior art electric flash device.
Figure 2:
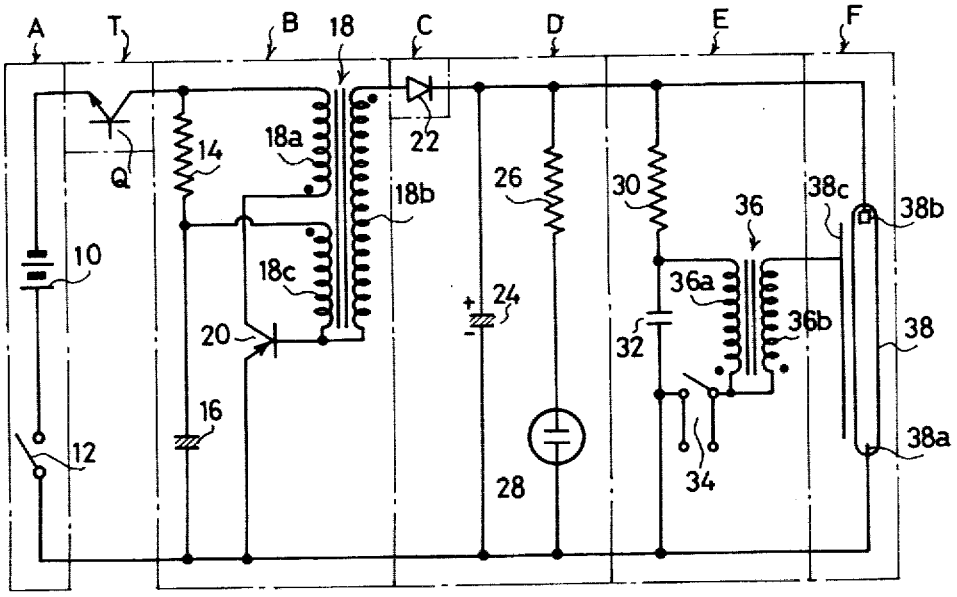
Fig.2 PRIOR ART
Figure 3:
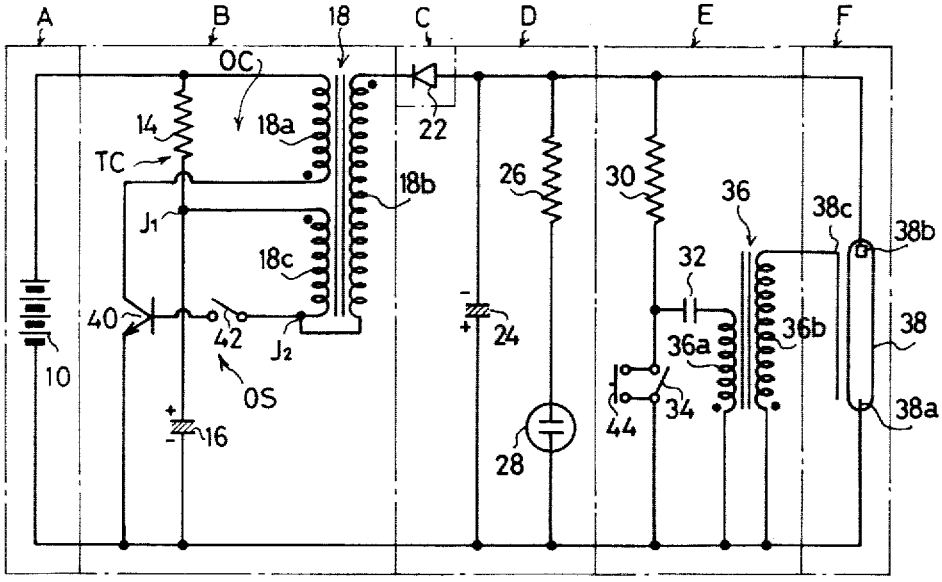
FIG. 3 is a detailed circuit diagram of an electric flash device according to the present invention.

Referring now once again to the drawings, FIG. 3 shows a circuit of an electric flash device in accordance with one embodiment of the present invention. As is shown in FIG. 3, the electric flash device comprises a direct-current power source circuit A, a voltage convertor circuit B for converting and boosting the voltage from the direct-current power source circuit A into alternating current voltage, a rectifier circuit C for rectifying the voltage from the boosted alternating current voltage, from the voltage convertor circuit B, a charging circuit D for charging the direct current supplied from the rectifier circuit C and for supplying electric energy to a flash tube, a trigger signal generating circuit E for triggering the flash tube by means of applying the triggering signal to a trigger electrode of the flash tube, and a flash tube circuit F which includes a flash tube.

As is best shown in FIG. 3, the direct current power source circuit A includes only a battery 10, and does not includes a power source switch. The voltage convertor circuit B comprises, substantially, an oscillator circuit OC, an oscillation time constant circuit TC and an oscillation starting circuit OS. In more detail, the voltage convertor circuit B includes a resistor 14 whose one terminal is directly connected to a positive electrode of the battery 10, a capacitor 16 whose one terminal is connected to other terminal of the resistor 14 to form the oscillation time constant circuit TC, an oscillating transformer 18, an oscillation switching element in the form of a high performance silicon transistor 40 and an oscillation starting switch in the form of a mechanical slide switch 42. The oscillating transformer 18 consists of a primary winding **18*a*, a secondary winding 18*b* and a third winding 18*c*. One terminal of the primary winding 18*a* is also directly connected to the positive electrode of the battery 10, and other terminal of the primary winding 18*a* is connected to a collector electrode in order to form the oscillator circuit OC. One terminal of the secondary winding 18*b* is connected to one terminal of the third winding 18*c*, and other terminal of the third winding 18*c* is connected to a juncture $J_1$ of the resistor 14 and the capacitor 16. The switch 42 is provided and connected between a base electrode of the transistor 40 and a juncture $J_2$ of the secondary winding 18*b* and the third winding 18*c* of the oscillating transformer 18** in order to constitute the oscillation starting circuit OS.

The oscillating transistor 40 is of a high performance NPN type, as is explained hereinabove, and has the high internal resistance. Accordingly, the leakage current of the transistor 40 is extremely small and is almost zero in comparison with that of the germanium transistor. It is, therefore, unnecessary to provide the power source switch in the power source circuit A.

The rectifier circuit C includes an electric value in the form of a diode 22 which cathode electrode is connected to other terminal of the secondary winding **18*b* of the transformer 18, and the diode 22 is provided so as to be reverse direction with respect to the polarity of the battery 10. The charging circuit D comprises a main storage capacitor 24, a current restricting resistor 26 and an indicating lamp in the form of a neon glow lamp 28 which is connected to the main storage capacitor 24 in parallel by way of the current restricting resistor 26. One terminal of the capacitor 24 is connected to an anode electrode of the diode 22, and other terminal of the capacitor 24 is connected to an emitter electrode of the transistor 40 and to a negative terminal of the battery 10**.

The trigger pulse generating circuit E has a charging resistor 30 whose one terminal is connected to the one terminal of the main storage capacitor 24, a triggering capacitor 32 whose one terminal is connected to other terminal of the resistor 30, a trigger transformer 36 having a primary winding **36*a* and a secondary winding 36*b* and parallely connected synchronizing switch 34 which is caused to go ON and OFF in synchronization with a camera shutter and an open flash test button switch 44. The primary winding 36*a* of the transformer 36 is connected between the triggering capacitor 32 and the switch 34. The flash tube circuit E comprises a gas-filled flash tube 38. The flash tube 38 is provided with a pair of main current conducting electrodes 38*a***, 38*b* and a trigger electrode 38*c* which is positioned adjacent but external to the flash tube 38. The trigger electrode 37*c* is connected to one terminal of the triggering transformer 36, and one main current conducting electrode 38*a* is connected to other terminal of the secondary winding 36*b*.

In operation, the switch 42 is manually actuated ON and OFF operation. When the switch 42 is OFF state, electric charge is stored on the capacitor 16 from the battery 10 through the resistor 14 at the polarity as shown in FIG. 3. By making the switch 42 to ON state, the base electrode of the transistor 40 is biased to conductive, and thereby the transistor 40 becomes conductive, because the electric charge of the capacitor 16 discharges through the third winding 18*c* of the transformer 18, the switch 42, the base electrode and the emitter electrode of the transistor 40. When the transistor 40 turns on, current flows through the primary winding 18*a* of the oscillating transformer 18, the collector-emitter path of the transistor 40 from the battery 10, and, at the same time, the current flows through the third winding 18*c*, the switch 42, the base-emitter electrodes of the transistor 40, the battery 10 and the resistor 14, and the electric charge is accumulated on the capacitor 16 and thereby the voltage convertor circuit B commences the oscillation and produces high alternating current voltage from the secondary winding 18*b*. The high alternating current voltage is rectified by the diode 22 of the rectifier circuit C, and high direct current voltage is generated from the rectifier circuit C.

The main storage capacitor 24 is charged by the high D.C. voltage from the rectifier circuit C. When the main storage capacitor 24 is fully charged up to the predetermined and suitable voltage, the neon glow lamp 28 lights indicating that the device is in readiness for the flash tube 38 to be fired. The flash tube 38 may then be fired by closing of the camera shutter switch 34 or the test button switch 44. As will be readily appreciated that this closing need only be momentary during the actuation of the camera shutter.

By closing the switch 34 or 44, the electric charge of the triggering capacitor 32 discharges through the switch 34 or 44 and the primary winding 36*a*. Then high voltage pulse is induced at the secondary winding 36*b* of the triggering transformer 36. The high voltage thus induced in the secondary winding 36*b* of the transformer 36 appears at the trigger electrode 38*c* of the flash tube 38 and ionizes a portion of the gas in the flash tube. The main storage capacitor 24 then discharges across the main current conducting electrodes gap and producing a brilliant flash of illumination. After the main storage capacitor 24 has been discharged, the power source circuit A builds up the charge again in preparation for the next flash.

According to the device shown in FIG. 3, since the high performance transistor 40 is employed in the oscillation starting circuit OS of the voltage convertor circuit B, the loss of the battery energy is prevented even when the switch 42 is left ON state for a long time period. Further, since the current which flows in the base circuit of the transistor 40 is small, voltage drop is eliminated even when long is a lead wire to be connected to the switch 42. It is, therefore, appreciated that good characteristics of the voltage convertor circuit B is obtained. Furthermore, an advantage is obtained that contacts of the switch 42 may be small capacity because the current which flows in the base electrode of the transistor 40 is about 1/20 of that of the primary current of the oscillating transformer 18.

Figure 4:
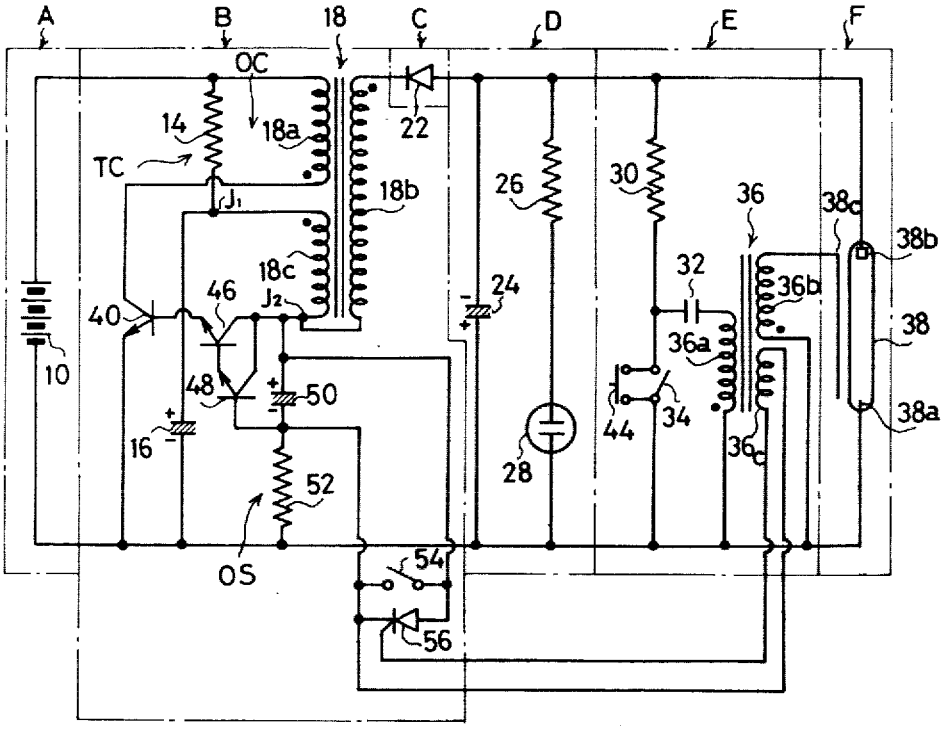
FIG. 4 is a detailed circuit diagram of an electric flash device which shows other embodiment of the electric flash device according to the present invention.

FIG. 4 is illustrative other possible embodiment of the present invention, and a device of FIG. 4 comprises, similar to the device of FIG. 3, a power source circuit A, a voltage convertor circuit B, a rectifier circuit B, a charging circuit D, a trigger pulse generating circuit E and a flash tube circuit F. The only difference from the device of FIG. 3 is that the voltage convertor circuit B is actuated and controlled by means of applying a voltage from the trigger pulse generating circuit E to an oscillation starting circuit OS, when a flash tube 38 is triggered.

More specifically, in the device of FIG. 4, the oscillation starting circuit OS consists of a transistor 40, a first control transistor 46, a second control transistor 48, a biasing capacitor 50, a pushbutton switch 54 and a control switching element in the form of a silicon controlled semiconductor element such as, for example, a thyristor 56. Further, the trigger pulse generating circuit E includes a trigger transformer 36 having a primary winding 36*a*, a secondary winding 36*b* and a third winding 36*c*.

In the oscillation starting circuit OS, an emitter electrode of the first control transistor 46 is connected to a base electrode of the transistor 40, and a collector electrode of the trasnsitor 46 is connected commonly to a third winding 18*c* of an oscillating transformer 18. An emitter electrode of the second control transistor 48 is connected to a base electrode of the first control transistor 46. Moreover, connected to the biasing capacitor 50 is a biassing resistor 52, and the switch 54 is connected to the baissing capacitor 50 in parallel relationship. The thyristor 56 is also connected to the switch 54 in parallel relationship. In addition, a gate electrode of the thyristor 56 is connected to one terminal of the third winding 36*c*, and a cathode electrode of the thyristor 56 is connected to other terminal of the third winding of the trigger transformer 36.

In accordance with the electric flash device of FIG. 4, when the switch 54 is opened, the capacitors 16 and 50 are charged by the current from the battery 10, at the polarity as is shown in the drawing. Accordingly, the second control transistor 48 is OFF state because it is biased to be non-conductive, and thereby the first control transistor 46 and the oscillating transistor 40 are also nonconductive state. In this case, current does not flow in the voltage convertor circuit B because the leakage current is extremely samll in the transistor 40. Under these conditions, when the switch 54 is closed, electric charge of the biassing capacitor 50 is fed-back to the battery 10 by way of the switch 54 and the resistor 52, then the second control transistor 48 is biased toward conductive and turns on. By turning on the transistor 48, the first control transistor 46 becomes conductive and thence the transistor 40 also becomes ON state for purposing of the commencement of the oscillation. When the oscillation is performed in the voltage convertor circuit B, the biassing capacitor 50 is automatically charged from the battery 10 by way of the resistor 14 and the secondary winding 18*b*. Since a charging time period of the biassing capacitor 50 is decided by the resistance value of the resistor 52, a timing of stopping of the oscillation can be variable.

When a voltage across the biassing capacitor 50 becomes a predetermined and desired value, the transistors 46 and 48 are cut off and the transistor 40 is also turned off, and thereby the oscillation is automatically stopped. Under this condition, the leakage current is less than several micro-ampere, and a power source switch is unnecessary in the power source circuit A.

In the trigger pulse generating circuit E, when the triggering capacitor 32 discharges through the primary winding 36*a* of the triggering transformer 36, a high voltage pulse appears at the secondary winding 36*b*. The voltage pulse is about 3,000 volts, and this voltage pulse is applied to the trigger electrode 38*c* of the flash tube 38 in order to fire the flash tube 38. In this case, the several volts appears at the third winding 38*c*. The induced voltage in the third winding 36*c* is applied to the thyristor 56 in the oscillation starting circuit OS as a gating signal of the thyristor 56, and the thyristor 56 is made conductive. When the thyristor 56 turns on, the electric charge of the biassing capacitor 50 discharges through the thyristor 56, and the voltage across the capacitor 50 reduces to turn on the transistors 48, 46 and 40. Thence the oscillation of the convertor B begins and repeats the operation as described hereinabove.

According to the electric flash device of FIG. 4, the thyristor 56 actuates by receiving a firing pulse from the third winding 36*c* of the transformer 36. In this case, the oscillation starting circuit OS is separated from the trigger pulse generating circuit E in D.C. voltage and current relationship. Namely, it will be readily apparent that the performance of the voltage convertor circuit B is maintain the stabilized condition, because the leakage current does not flow from the trigger pulse generating circuit E to the biassing capacitor 50.

Under a condition that the main storage capacitor 24 is fully charged, if the electric flash device is left unsused state for a long period such as, for example, during half-day or one day, the electric charge of the capacitor 24 and the triggering capacitor 32 gradually decrease, and the thyristor 56 becomes nonconductive state, because the induced voltage at the third winding 36*c* is lowered. Under these conditions, the voltage convertor circuit can be operated by closing the switch 54.

Figure 5:
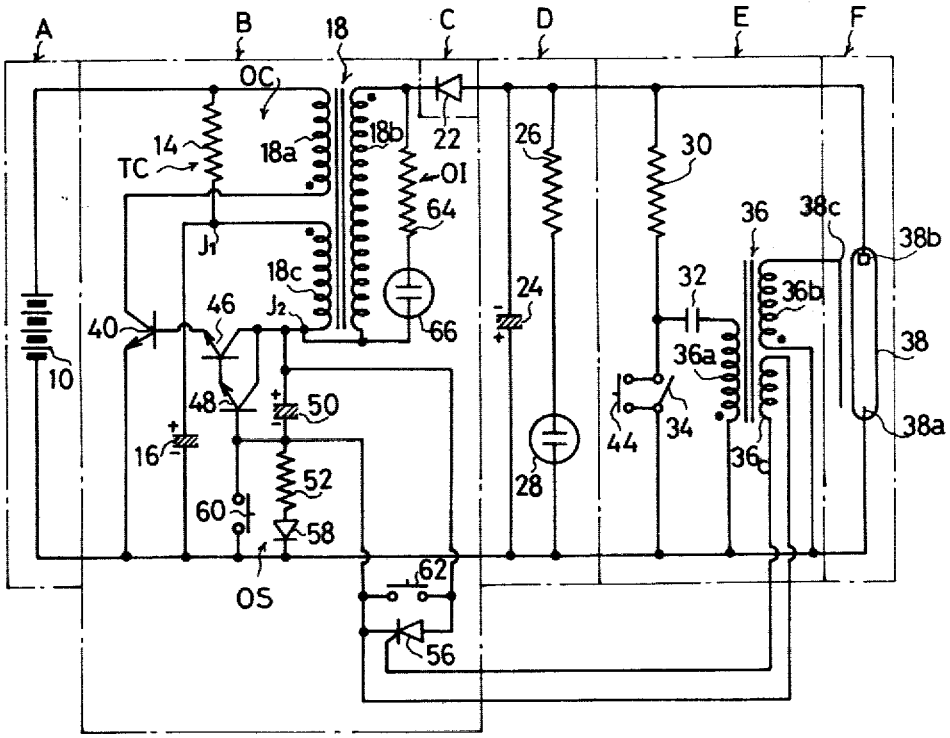
FIG. 5 shows a modification of the circuit of FIG. 4.

FIG. 5 shows the most effective electric flash device which is most effectively embodys the present invention. In the embodiment of FIG. 5, the device comprises also a power source circuit including a battery, a voltage convertor circuit B, a rectifier circuit, a charging circuit D, a trigger pulse generating circuit E and a flash tube circuit D. Particularly, the voltage convertor circuit B is greatly improved by providing a switch for stopping the oscillation and an indicating circuit for indicating an oscillation condition thereinto.

As is best shown in FIG. 5, an oscillation starting circuit OS is provided an electric valve in the form of a diode 58 of which an anode electrode is connected to a resistor 52 and a cathode electrode is connected to a positive terminal of a battery 10, an oscillation stopping switch 60 which is manually and momentary operated for stopping the activation of the voltage convertor circuit B and a push-button switch 62 which is parallely connected to a thyristor 56. Further, an oscillation indicating circuit OI is provided in the output side of a transformer 18. The oscillation indicating circuit consists of an indicating lamp in the form of a neon glow lamp 66 which is connected between both terminals of the secondary winding 18*b* by way of a current-restricting resistor 64. The neon glow lamp 66 is employed in order to confirm whether the oscillation in the voltage convertor circuit B are normally performed or not.

The operation of the electric flash device, in accordance with FIG. 5, will now be explained: When the switch 62 is closed for starting the oscillation, the electric charge discharges through the switch 62, the resistor 52 and the diode 58 from the biassing capacitor 50, and all of the transistors 48, 46 and 40 are biassed conductive. When the transistor 40 turns ON, the voltage convertor circuit B performs the oscillating operation and at the same time a high A.C. voltage is induced at the secondary winding 18*b* of the oscillating transformer 18. The induced voltage at the secondary winding 18*b* renders the electric charge to store on the main storage capacitor 24 by the manner as describes foregoing, and renders the neon lamp to glow, and thereby the normal operation may be confirmed.

When the main storage capacitor 24 is charged to the predetermined and desired voltage, the capacitor 24 discharges through the flash tube 38 by activating the trigger pulse generating circuit E. By the activation of the trigger pulse generating circuit E, the thyristor 56 maintains the ON state.

The voltage convertor circuit B performs the continuous oscillation as long as the thyristor 56 maintains the conductive. It is, accordingly convenience to flash the flash tube 38 continuously. Under the continuous oscillating condition, if the switch 60 is closed, the second control transistor 48 becomes nonconductive, since the base electrode is biassed to negative from the negative electrode of the battery 10. When the transistor 48 is cut off, both of the transistor 46 and 40 are also turned OFF. Accordingly, the oscillation of the voltage convertor circuit B may also be stopped by closing the switch 60. In addition, the diode 58 activates the function so that the electric charge is stored on the biassing capacitor 50 and so as to prevent the current flowing from the biassing capacitor 50, and thereby enhanced is the performance of the voltage convertor circuit B. In the electric flash device of FIG. 5, the operation of the voltage convertor circuit B can also be stopped automatically after the given time period which is decided by the resistance valve of the resistor 52, because the biassing capacitor 50 is gradually charged to the present voltage value.

Figure 6:
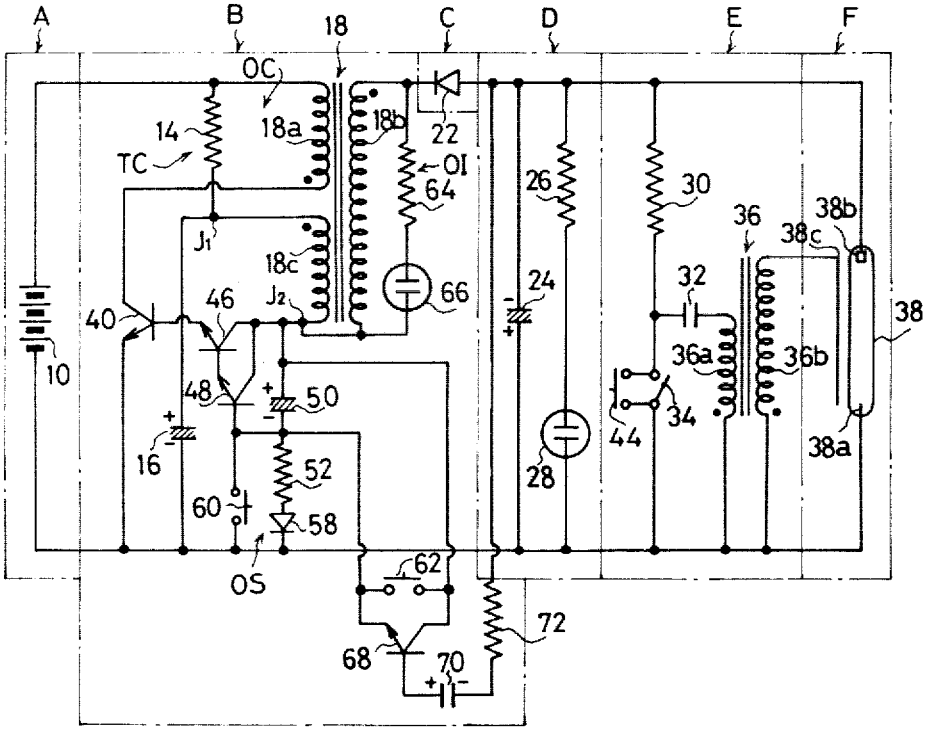
FIG. 6 is a detailed circuit diagram of further embodiment of the electric flash device according to the present invention.

FIG. 6 illustrates an electric flash device which is also employed in the present invention. In accordance with the electric flash device of FIG. 6, a transistor 68 is employed instead of a thyristor. Namely, an emitter electrode and a collector electrode of the transistor 68 are respectively connected to a switch 62 so that the transistor 68 is connected in parallel to the switch 62 between the emitter electrode and the collector electrode thereof. Further, a capacitor 70 is connected between a base electrode and a juncture of a diode 22 and a main storage capacitor 24 by way of a resistor 72.

According to the device of FIG. 6, the transistor 68 is, initially, nonconductive, because the negative voltage has applied to the base electrode of transistor 68, not withstanding ON and OFF operations of the pushbutton switch 62. An oscillating operation has been, therefore, continued until the biassing capacitor is charged up to the predetermined voltage. The oscillation of the voltage convertor circuit B ceases to oscillate when the biassing capacitor 50 is charged to the predetermined voltage value. If the flash tube 38 is fired after or immediately before the oscillation is ceased, the electric charge accumulated on the capacitor 70 is discharged through the flash tube 38, thence the induced voltage appears across the capacitor 70 at the polarity as is shown in FIG. 6, and thereby the transistor 68 is made conductive. By the conduction of the transistor 70, the electric charge of the biassing capacitor 50 is discharged by way of the transistor 70 and thereafter, the oscillation is automatically started.

According to the device of FIG. 6, cost of the device is eliminated, because an inexpensive transistor is used instead of an expensive thyristor, and further, the device becomes small because a triggering transformer having only two windings may be fully used.

While a preferred embodiments of the invention has been shown and described, it will be apparent to these skilled in the art that modifications can be made without departing from the principle and spirit of the invention, the scope of which is defined in the appended claims. Accordingly, the foregoing embodiment is to be considered illustrative, rather than restricting of the invention and those modifications which come with in the meaning and range of equivalency of the claims are to be included herein.

What is claimed is:

1. An electric flash device comprising a direct current power source circuit including a direct current power source for providing a direct current voltage, a flash tube circuit including a flash tube, a voltage converter circuit for converting said direct current voltage of said direct current power source to an alternating current voltage, a rectifier circuit for rectifying said alternating current voltage to a direct current voltage, a charging circuit for storing an electric charge and for supplying electrical energy to said flash tube, and a trigger pulse generating circuit for triggering said flash tube of the flash tube circuit, said voltage converter circuit comprising an oscillating transformer connected to said direct current power source for generating a high alternating current voltage and having a current flowing therein, an oscillator circuit for performing an oscillating operation including an oscillating switch element having a high leakage resistance for switching said current which flows in said oscillating transformer and functioning as a high resistance resistor when the oscillating operation of said oscillator circuit ceases, said oscillating switch element including a control electrode circuit, and an oscillation starting circuit including a switching means, provided in said control electrode circuit of said oscillating switch element of said oscillator circuit, for turning on said oscillating switch element of said oscillator circuit.

2. An electric flash device as claimed in claim 1, wherein said switching means includes a switching element having a high leakage resistance, a biasing capacitor, and a manually operated mechanical switch.

3. An electric flash device as claimed in claim 2 wherein said switch means of said oscillation starting circuit comprises a switching element having high leakage resistance and a manually operated mechanical switch.

4. An electric flash device as claimed in claim 1, further comprising control means for controlling said voltage converter circuit when said trigger pulse generating circuit is activated.

5. An electric flash device as claimed in claim 4 wherein said control means further includes a biasing capacitor and an electric valve connected to said biasing capacitor by way of a biasing resistor.

6. An electric flash device as claimed in claim 5 wherein said electric valve is a diode.

7. An electric flash device as claimed in claim 1, further comprising an oscillation indicating means for indicating oscillating operation of said oscillator circuit and connected to said secondary winding of said oscillating transformer.

8. An electric flash device as claimed in claim 7, wherein said oscillation indicating means includes a neon glow lamp.

9. An electric flash device comprising a direct current power source circuit including a direct current power source for providing a direct current voltage, a flash tube circuit including a flash tube, a voltage converter circuit for converting said direct current voltage of said direct current power source to an alternating current voltage, a rectifier circuit for rectifying said alternating current voltage to a direct current voltage, a charging circuit for storing an electric charge and for supplying electrical energy to said flash tube, and a trigger pulse generating circuit for triggering said flash tube of the flash tube circuit, said voltage converter circuit comprising an oscillating transformer connected to said direct current power source for generating a high alternating current voltage and having a current flowing therein, an oscillator circuit for performing an oscillating operation including an oscillating switch element having a high leakage resistance for switching said current which flows in said oscillating transformer and functioning as a high resistance resistor when the oscillating operation of said oscillator circuit ceases, and an oscillation starting circuit including a switching means for turning on said oscillating switch element of said oscillator circuit, wherein said oscillating transformer has a primary winding arranged for connection across said power source, a secondary winding, and a third winding connected to said switching element of said switching means by way of said switch means of said oscillation starting circuit.

10. An electric flash device as claimed in claim 9 wherein said switching element is a silicon transistor having high leak resistance, in which a collector electrode is connected to the primary winding of said oscillating transformer and a base electrode is connected to the third winding by way of said switching means of said oscillation starting circuit.

11. An electric flash device as claimed in claim 10, wherein said switch means of said oscillation starting circuit is a manually operated mechanical switch connected between the base electrode of said NPN silicon transistor and one terminal of said third winding.

12. An electric flash device as claimed in claim 10 further comprising control means for controlling said voltage converter circuit including a control switching means for controlling ON and OFF operations of said oscillating switch element of the oscillator circuit, and a biasing capacitor for biasing said control switching means.

13. An electric flash device as claimed in claim 12 wherein said triggering pulse generating circuit includes a trigger transformer, and said bias control switching element is a thyristor which is fired by a gating signal from said trigger transformer of the triggering pulse generating circuit.

14. An electric flash device as claimed in claim 12 wherein said control switching means further includes a switch for controlling ON and OFF operations of said control switch element.

15. An electric flash device as claimed in claim 12, wherein said control means for controlling said voltage converter circuit further includes a bias control switching element for controlling the biasing operation of said biasing capacitor by means of a control signal supplied when the flash tube is fired.

16. An electric flash device as claimed in claim 15 wherein said bias control switching element is a transistor whose emitter-collector path is connected to the bias control switch and whose base electrode is connected to one main current electrode of the flash tube.

* * * * *